US006676354B2

(12) United States Patent
Holtmeier et al.

(10) Patent No.: US 6,676,354 B2
(45) Date of Patent: Jan. 13, 2004

(54) PROCESS FOR CASING A BOOK BLOCK OR PAPER-COVER BLOCK INTO A COVER, AND DEVICE FOR PERFORMING THE PROCESS

(75) Inventors: Thorsten Holtmeier, Bünde (DE); Gunther Knittel, Bad Iburg (DE)

(73) Assignee: Kolbus GmbH & Co. KG, Rahden (DE)

( * ) Notice: Subject to any disclaimer, the term of this patent is extended or adjusted under 35 U.S.C. 154(b) by 172 days.

(21) Appl. No.: 09/773,096

(22) Filed: Jan. 31, 2001

(65) Prior Publication Data

US 2001/0014265 A1 Aug. 16, 2001

(30) Foreign Application Priority Data

Feb. 12, 2000 (DE) ..... 100 06 334
May 17, 2000 (DE) ..... 100 24 068

(51) Int. Cl.[7] ..... B42C 9/00; B42C 11/00; B42C 13/00

(52) U.S. Cl. ..... 412/6; 412/1; 412/4; 412/5; 412/8; 412/17; 412/21; 412/22; 412/29; 412/33; 412/37

(58) Field of Search ..... 412/1, 4, 5, 6, 412/17, 21, 33, 22, 29, 37, 8

(56) References Cited

U.S. PATENT DOCUMENTS 3,223,436 A * 12/1965 Becker ..... 412/8
3,451,082 A * 6/1969 Sarring ..... 412/5
4,420,282 A * 12/1983 Axelrod ..... 412/19
4,556,353 A * 12/1985 Ehlermann ..... 412/19
4,984,949 A * 1/1991 Reckziegel ..... 156/216
5,104,275 A * 4/1992 Rathert ..... 412/1
5,429,468 A * 7/1995 Kojima ..... 412/19
5,454,680 A * 10/1995 Lazar ..... 412/41
5,788,446 A * 8/1998 Stolz ..... 412/9
5,800,110 A * 9/1998 Georgitsis et al. ..... 412/3
5,868,539 A * 2/1999 Rathert ..... 281/21.1
6,142,721 A * 11/2000 Marsh ..... 281/21.1
6,168,363 B1 * 1/2001 Nehring ..... 412/30
6,206,358 B1 * 3/2001 Yamaguchi et al. ..... 270/52.02
6,250,868 B1 * 6/2001 Schmucker ..... 412/25
6,273,661 B1 * 8/2001 Payne ..... 156/578
2002/0164229 A1 * 11/2002 Hocking ..... 412/8

FOREIGN PATENT DOCUMENTS

JP 2001246871 * 9/2001

* cited by examiner

*Primary Examiner*—A. L. Wellington
*Assistant Examiner*—Mark T. Henderson
(74) *Attorney, Agent, or Firm*—Alix, Yale & Ristas, LLP

(57) ABSTRACT

In a process for casing a book block or paper-cover block into a cover during the manufacture of adhesively bound books, paper covers or magazines in an adhesive binding machine in which the block is transported, with a hanging-out portion, in a block clamp belonging to a transport system and is connected to the cover by gluing the back and/or the side regions, provision is made, in order to achieve an increase in quality, for the hanging-out portion (1*a*) of the block (1) to be aligned with the back region (2*a*), which is preferably predetermined by scoring, of a cover (2) which is fed in, and for the said cover (2) to be pressed against the back and/or the side regions of the block (1).

16 Claims, 1 Drawing Sheet

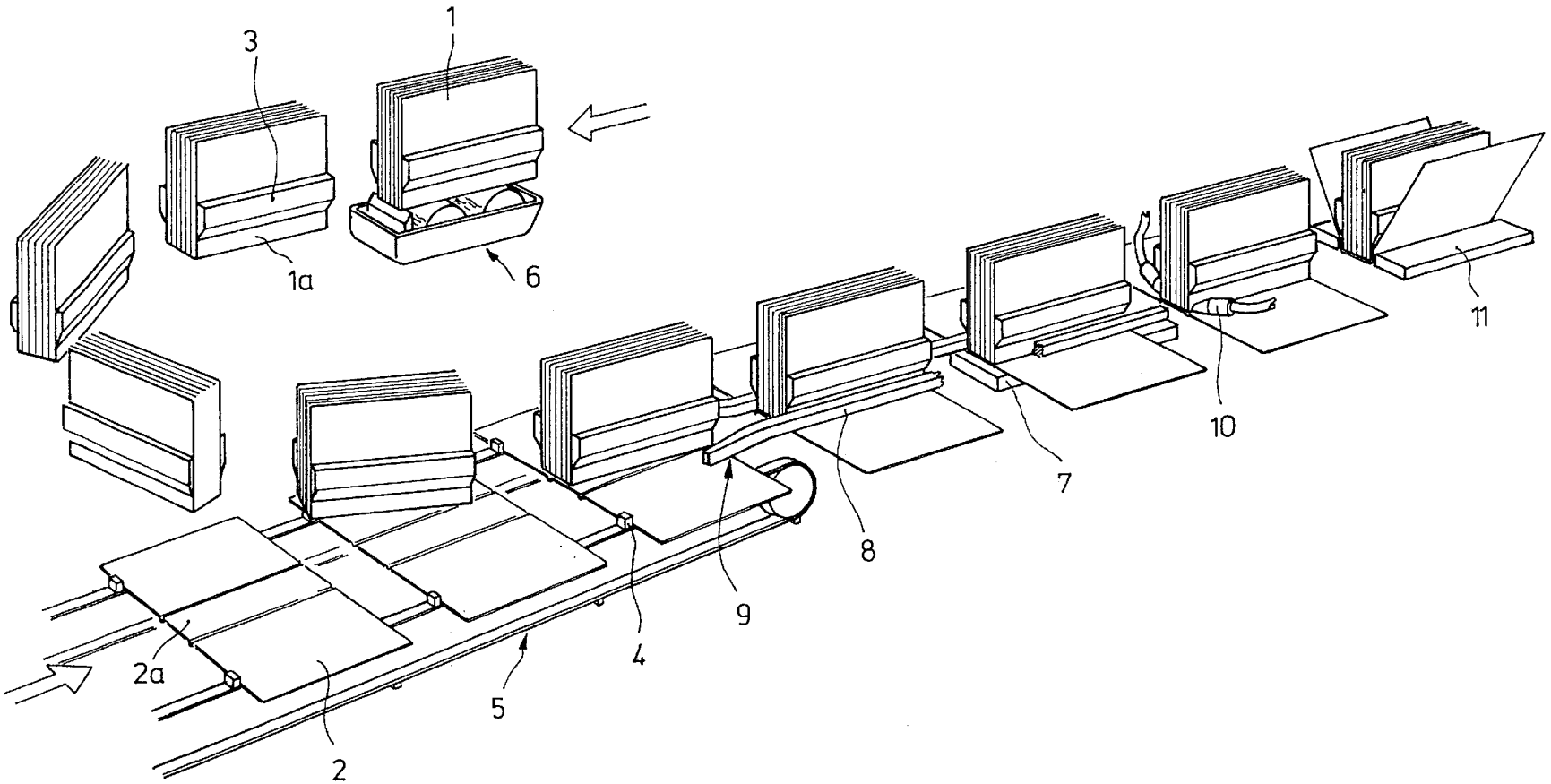
11
10
7
8
9
4
5
6
1
1a
3
2
2a

PROCESS FOR CASING A BOOK BLOCK OR PAPER-COVER BLOCK INTO A COVER, AND DEVICE FOR PERFORMING THE PROCESS

BACKGROUND OF THE INVENTION

The invention relates to a process, and to a device for performing the process, for casing a book block or paper-cover block into a cover during the manufacture of adhesively bound books, paper covers and magazines in an adhesive binding machine.

In an adhesive binding machine for manufacturing books, paper covers or magazines, leaves or folded sheets which have been gathered together are transported, with a defined hanging-out portion, in block clamps belonging to a transport system, and are connected to form a book block or paper-cover block by the application of an adhesive to the machined back of the block. The connection of a scored cover to the book block or paper-cover block which has previously been provided with a lateral coating of glue, the so-called "casing-in" operation, takes place in a cover laying-on and pressing-on arrangement, the said cover being pressed against the back of the block and adjoining side regions during the continuous movement of the book block or paper-cover block.

Instead of the normal procedure of coating the spine of the block which are used herein refers to the back of the block and/or its adjoining side regions with glue by means of rollers and discs, the adhesive can also be applied to the cover using nozzles, in a manner corresponding to the breadth of the back of the block and of the side regions to be coated with glue.

As a result of various correlations and influences in the pre-production process, a more or less pronounced expansion occurs in the back of the block, the so-called "mushroom formation", which may also have an asymmetrical shape. As experience shows, this not infrequently leads, when the cover and block are joined, to inaccurate centring of the back of the block in relation to the scoring on the cover or in relation to the bent edges. The consequence of this is an inferior quality of the product, such as an unsightly shape for the back, a title impression which extends at an angle in relation to the edge of the back, and also the formation of folds on the first and last pages of the block when the cover is pressed on laterally. The said formation of folds can also occur in so far as the pressed-on sides of the cover, after being released by the pressing-on station, detach themselves from the adhesive bond, together with the first and last pages, as a result of the recovery forces of the cover. Because of the sticking power of the adhesive between the applying discs of the adhesive-applying device and the sides of the block, there is also the risk, particularly in the case of thin papers, of the outer leaves or layers coming off the block, something which can likewise entail the formation of folds during the pressing-on operation. All this not only affects the quality of the books, paper covers or magazines, but also has an adverse effect on the adhesion.

The object of the invention consists in proposing, while avoiding the disadvantages of the prior art, a process for casing a book block or paper-cover block into a cover during the manufacture of adhesively bound books, paper covers or magazines in an adhesive binding machine, and a device for performing the said process, with the aid of which process and device a substantial increase in the quality of the products can be made possible.

This is achieved by means of the invention in a surprisingly simple manner through the fact that, according to a first idea of the invention, the hanging-out portion of the block is aligned with the back region, which is preferably predetermined by scoring, of a cover which is fed in, and the said cover is pressed against the spine of the block which includes the back and/or the side regions of the block.

According to a second idea of the invention, the block is coated with glue on the back, the hanging-out portion is optionally aligned with the back region of the cover which is fed in, the said cover is pressed against the back, and the side regions of the block or of the cover are thereupon coated with glue and the cover is pressed on laterally.

In order to perform the process, a centring arrangement is provided which acts, from opposite sides, on the hanging-out portion of a block transported in a block clamp belonging to an adhesive binding machine, and aligns the said block with the centre of the block clamp. Further features of the process and device emerge from the dependent claims.

With the aid of the process and of the device for performing the process, it is possible to manufacture adhesively bound books, paper covers or magazines, which are of high quality in respect of both aesthetics and also physical properties. It is particularly advantageous if, before the cover is pressed on, the hanging-out portion of the book block or paper-cover block is aligned, in a positionally precise manner, with the back region of the cover, which back region is preferably predetermined by scoring. As a result of this, the first and last pages of the book block or paper-cover block are always located exactly between the scoring on the back.

The invention will be explained in greater detail below with the aid of the drawing, in which a bookbinding machine with a centring arrangement according to the invention is diagrammatically represented, on an exemplary basis, in a perspective view.

In a bookbinding machine, a so-called adhesive binder, for manufacturing adhesively bound paper covers, it is possible to make out a multitude of block clamps 3, which are disposed at identical distances from one another, for clamping-in blocks 1 with a defined hanging-out portion 1*a*. As is known, the block clamps 3 are located, guided in tracks, on a continuous chain belonging to a transport system and running around rerouting chain wheels, and are fastened in a movable manner, drive-wise, to the points of articulation of the chain links.

In order to case a block 1 into a cover 2, the latter is fed from below, by the rear engagement of transporters 4 carried on a conveyer 5 and while aligned with a reference edge, to the block 1 which has been previously coated with glue on the back by means of an adhesive-applying arrangement 6, and in the process, the hanging-out portion 1*a* of the block is aligned with the back region 2*a,* which is preferably predetermined by scoring, in a positionally precise manner and is pressed against the back of the block 1 by a pressure-applying table 7.

According to the invention, stationary centring rails 8, which align the hanging-out portion 1*a* of a block 1, which is fed in the block clamp 3, with the centre of the said block clamp 3 from opposite sides, are located between the block clamps 3 and the pressure-applying table 7 at a distance from one another which corresponds to the thickness of the block.

In the initial region, the centring rails 8 form a run-in section 9 which takes over the hanging-out portion 1*a* of the block 1 directly from the rerouting device of the transport system and brings it to the center of the block clamp 3.

Instead of the centring rails 8, use may be made, for the purpose of aligning the hanging-out portion 1*a* of the block 1, of mutually opposed rows of freely rotatable rollers belonging to a roller track with a suitable run-in section. The distance of the centring rails 8 or rows of rollers from one another can be set to the particular thickness of the block 1.

Nozzles 10, which apply a strip of adhesive to the side regions of the block 1, are disposed after the centring rails 8, and the lateral pressing-on of the cover 2 by pressing-on rails 11 then takes place as the procedure continues.

The invention is not restricted to the exemplified embodiment represented and described. Instead of the application of adhesive to the back and the side regions of the block 1, or only to the side regions in the case of products with a hollow back, the adhesive may also be applied to the cover 2 via nozzles, and the adjustment of the hanging-out portion of the block 1 in the block clamp 3 takes place afterwards, with subsequent pressing-on against the back and/or against the side regions of the block 1. What is essential is that the hanging-out portion of the block 1 is aligned with the back region 2*a* of the scored cover 2 in a positionally precise manner, before connection to the cover 2 takes place.

According to a second concept of the invention in the case of the process, in order to avoid the formation of folds on the first and last pages of the block, the said block is first of all coated with glue on the back and the cover pressed against the back of the block. The coating of the side regions with glue and the lateral pressing-on of the cover take place after that. In the case of strong papers, it is possible to omit alignment of the hanging-out portion of the block. What is essential is the pressing-on of the cover against the back of the block before the coating of the side regions with glue, as a result of which detachment of the first and last pages of the block from the adhesive bond by the adhesive-applying discs is prevented.

What is claimed:

1. A method for casing a block of printed sheets into a cover in an adhesive binding machine, wherein the block has a back and opposite side surfaces defining a nominal block width and is transported in a block clamp having opposed clamp members that are spaced a distance corresponding to the nominal block width, said back and a portion of said side surfaces of the block together defining a spine that hangs out of the clamp with a spine width greater than the nominal block width, each said clamp transporting a respective block to a cover pressing-on station where the back of the block is positioned adjacent a back region of a respective cover having spaced apart score lines, and the block is connected to the cover by gluing at least a part of the spine to a portion of the cover, wherein the improvement comprises that, after glue has been applied to one of the spine or the cover but before the cover is connected to the spine, the spine width is decreased whereby the spine is aligned between the score lines of the cover such that the width of the block at the spine corresponds to the distance between the score lines of the cover.

2. The method of claim 1, comprising the sequence of:

coating the backs of respective blocks with glue;

decreasing said spine width;

pressing the backs of respective blocks against only the back regions of respective covers;

coating only said side surfaces of respective spines with glue; and pressing portions of respective covers against only the coated side surfaces of respective spines.

3. The method of claim 1, comprising the sequence of:

coating the backs of respective blocks with glue;

decreasing said spine width;

pressing the backs of respective blocks against only the back regions of respective covers;

coating with glue only portions of respective covers adjacent the side surfaces of respective spines; and pressing the glued portions of respective covers against the side surfaces of respective spines.

4. The method of claim 1, comprising the sequence of:

coating the back region on each of said covers with glue;

decreasing said spine width;

pressing the backs of respective blocks against the back regions of respective covers;

coating the side surfaces of respective spines with glue; and pressing portions of respective covers against the glued side surfaces of respective spines.

5. The method of claim 1, comprising the sequence of:

coating only the back region on each of said covers with glue;

decreasing said spine width;

pressing the backs of respective blocks against the glued back regions of respective covers;

coating with glue only portions of respective covers adjacent the side surfaces of respective spines; and pressing said adjacent glued portions of respective covers against the side surfaces of respective spines.

6. A method for casing a block of printed sheets into a cover in an adhesive binding machine, wherein the block has a back and opposite side surfaces defining a nominal block width and is transported in a block clamp having opposed clamp members that are spaced a distance corresponding to the nominal block width, said back and a portion of said side surfaces of the block together defining a spine that hangs out of the clamp with a spine width greater than the nominal block width, each said clamp transporting a respective block to a cover pressing-on station where the back of the block is positioned adjacent a back region of a respective cover, and the block is connected to the cover by gluing at least a part of the spine to a portion of the cover, wherein the improvement comprises that, after glue has been applied to one of the spine or the cover but before the cover is connected to the spine, the spine width is decreased whereby the spine is aligned with the clamp such that the width of the block at the spine corresponds to the distance of the space between said clamp members.

7. A method for casing blocks of printed sheets into covers, comprising the steps of:

(a) providing a plurality of blocks, each of said blocks having a spine, each spine comprising a back and adjacent side surfaces;

(b) providing a plurality of book clamps dimensioned and configured for connection with each of said blocks;

(c) clamping each of said blocks with the spine of each block disposed in depending relationship to the clamp;

(d) providing a respective plurality of covers each having a back region that is dimensioned and configured for connection with the back of a block;

(e) coating only the backs of respective blocks with glue;

(f) after step (e) pressing the backs of respective blocks against the back regions of respective covers;

(g) after step (f) coating only said side surfaces of respective spines with glue; and (h) after step (g) pressing portions of respective covers against only the side surfaces of respective spines.

8. A method for casing blocks of printed sheets into covers, comprising the steps of:

(a) providing a plurality of blocks, each of said blocks having a spine, each spine comprising a back and adjacent side surfaces;

(b) providing a plurality of book clamps dimensioned and configured for connection with each of said blocks;

(c) clamping each of said blocks with the spine of each block disposed in depending relationship to the clamp;

(d) providing a respective plurality of covers each having a back region that is dimensioned and configured for connection with the back of a block;

(e) coating only the backs of respective blocks with glue;

(f) after step (e) pressing the backs of respective blocks against only the back regions of respective covers;

(g) after step (f) coating with glue only portions of respective covers adjacent the side surfaces of respective spines; and (h) after step (g) pressing the glued portions of respective covers against the side surfaces of respective spines.

9. A method for casing blocks of printed sheets into a covers, comprising the steps of:

(a) providing a plurality of blocks, each of said blocks having a spine, each spine comprising a back and adjacent side surfaces;

(b) providing a plurality of book clamps dimensioned and configured for connection with each of said blocks;

(c) clamping each of said blocks with the spine of each block disposed in depending relationship to the clamp;

(d) providing a respective plurality of covers each having a back region that is dimensioned and configured for connection with the back of a block;

(e) coating with glue only the back region on each of said covers;

(f) after step (e) pressing the backs of respective blocks against the back regions of respective covers;

(g) after step (f) coating said side surfaces of respective spines with glue; and (h) after step (g) pressing portions of respective covers against the glued side surfaces of respective spines.

10. A method for casing blocks of printed sheets into covers, comprising the steps of:

(a) providing a plurality of blocks, each of said blocks having a spine, each spine comprising a back and adjacent side surfaces;

(b) providing a plurality of book clamps dimensioned and configured for connection with each of said blocks;

(c) clamping each of said blocks with the spine of each block disposed in depending relationship to the clamp;

(d) providing a respective plurality of covers having a back region that is dimensioned and configured for connection with the back of a block;

(e) coating with glue only the back region on each of said covers;

(f) after step (e) pressing the backs of respective blocks against the glued back regions of respective covers;

(g) after step (f) coating with glue only portions of respective covers adjacent the side surfaces of respective spines; and (h) after step (g) pressing said adjacent glued portions of respective covers and against the sides of respective spines.

11. In an adhesive binding machine for casing a block of printed sheets into a cover, wherein the block has a back and opposite side surfaces defining a nominal block width and is transported in a block clamp having opposed parallel clamp members that are spaced a distance corresponding to the nominal block width, said back and a portion of said side surfaces of the block together defining a spine that hangs out of the clamp, each said clamp transporting a respective block to a cover pressing-on station where the back of the block is positioned adjacent a back region of a respective cover, and the block is connected to the cover by gluing at least a part of the spine to a portion of the cover, wherein the improvement comprises a spine centring means including opposed, adjustable guide members arranged in parallel, which acts from opposite directions against the hanging-out spine to assure that the side surfaces of the block at the spine are parallel.

12. The adhesive binding machine of claim 11, wherein the parallel guide members are adjustable to be spaced apart the same distance as the space between opposed clamp members.

13. The adhesive binding machine of claim 11, wherein the spine centring means have a converging entrance portion for leading each spine into said parallel guide members.

14. The adhesive binding machine of claim 11, wherein the guide members are rails or tracks and the distance between the guide members is adjustable to the nominal block width.

15. In an adhesive binding machine for casing a block of printed sheets into a cover, wherein the block has a back and opposite side surfaces defining a nominal block width and is transported in a block clamp having opposed parallel clamp members that are spaced a distance corresponding to the nominal block width, said back and a portion of said side surfaces of the block together defining a spine that hangs out of the clamp, each said clamp transporting a respective block to a cover pressing-on station where the back of the block is positioned adjacent a back region of a respective cover, and the block is connected to the cover by gluing at least a part of the spine to a portion of the cover, wherein the improvement comprises:

a spine centring means disposed above the cover pressing-on station, which acts from opposite directions against the hanging-out spine to assure that the side surfaces of the block at the spine are parallel;

means upstream of the spine centring means and the cover pressing-on station, for applying an adhesive to only the back of the spine;

means after the spine centring means and cover pressing-on station for applying an adhesive to the side surfaces of the spine; and means downstream of the spine centring means and cover pressing-on arrangement, for pressing the cover laterally against the side surfaces of the spine.

16. The adhesive binding machine of claim 15, wherein the spine centring means is fixed between the cover pressing-on station and the block clamp of a block to be cased.

* * * * *